United States Patent [19]

Herklotz et al.

[11] 4,433,281

[45] Feb. 21, 1984

[54] METHOD FOR DETECTING BREAKDOWNS IN AN ELECTROSTATIC FILTER

[75] Inventors: Helmut Herklotz, Neu Isenburg; Günter Mehler, Frankfurt am Main; Franz Neulinger, Dietzenbach; Helmut Schummer, Heusenstamm; Horst Daar, Erlangen; Walter Schmidt, Uttenreuth; Heinrich Winkler, Neunkirchen, all of Fed. Rep. of Germany

[73] Assignee: Siemens Aktiengesellschaft, Munich, Fed. Rep. of Germany

[21] Appl. No.: 213,031

[22] Filed: Dec. 4, 1980

[30] Foreign Application Priority Data

Dec. 11, 1979 [DE] Fed. Rep. of Germany ..... 2949752

[51] Int. Cl.[3] ..... G05F 1/455

[52] U.S. Cl. ..... 323/246; 55/105; 323/903

[58] Field of Search ..... 55/105; 323/237, 246, 323/903

[56] References Cited

U.S. PATENT DOCUMENTS 4,138,232 2/1979 Winkler et al. .

*Primary Examiner*—William M. Shoop
*Attorney, Agent, or Firm*—Kenyon & Kenyon

[57] ABSTRACT

A method for detecting breakdowns in an electrostatic filter in which single measured values of equal phase of successive half waves of the filter voltage and crest values of successive half waves of the primary current are compared with one another and in which the differences of the measured values at which a breakdown signal is delivered are made dependent on the existing filter voltage or the primary current.

4 Claims, 4 Drawing Figures

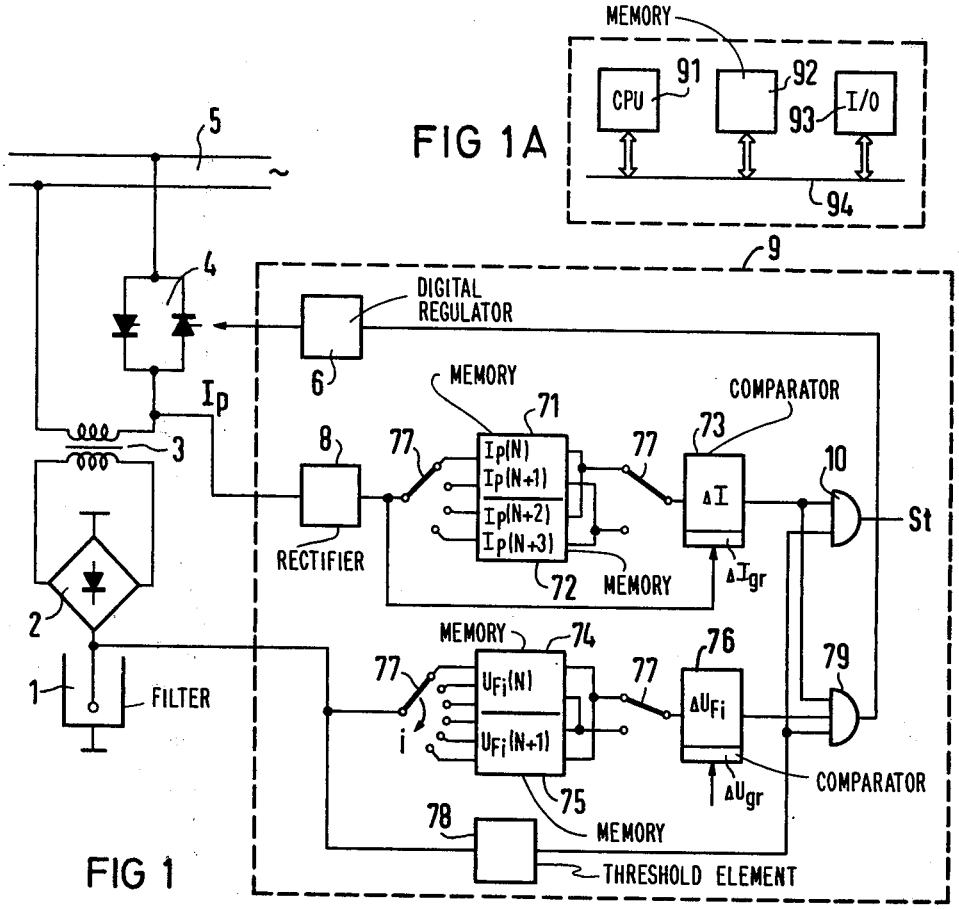
MEMORY
CPU
91
92
93
I/O
94
FIG 1A
5
4
9
DIGITAL REGULATOR
6
MEMORY
71
COMPARATOR
73
Ip
3
8
77
Ip(N)
Ip(N+1)
Ip(N+2)
Ip(N+3)
77
ΔI
10
St
RECTIFIER
72
MEMORY
ΔIgr
2
MEMORY
74
76
79
1
FILTER
77
UFi(N)
UFi(N+1)
77
ΔUFi
i
COMPARATOR
75
ΔUgr
78
MEMORY
THRESHOLD ELEMENT
FIG 1
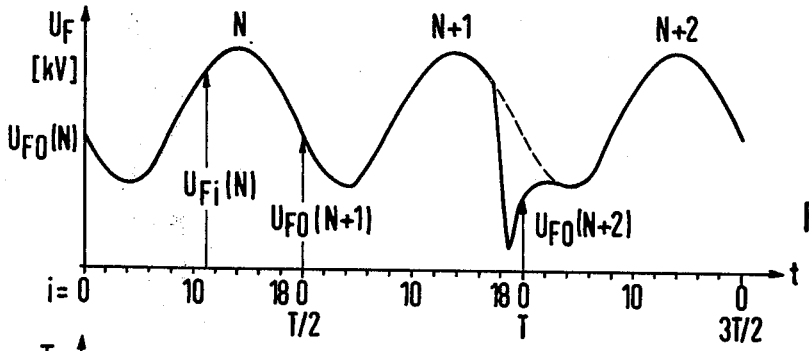
UF
[kV]
N
N+1
N+2
UFO(N)
UFi(N)
UFO(N+1)
UFO(N+2)
i= 0
10
18 0
10
18 0
10
0
T/2
T
3T/2
t
FIG 2
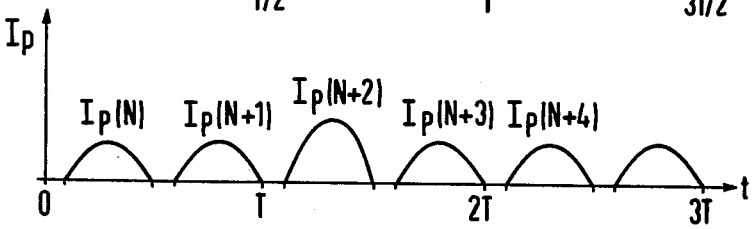
Ip
Ip(N)
Ip(N+1)
Ip(N+2)
Ip(N+3)
Ip(N+4)
0
T
2T
3T
t
FIG 3

METHOD FOR DETECTING BREAKDOWNS IN AN ELECTROSTATIC FILTER

BACKGROUND OF THE INVENTION

This invention relates to a method for detecting breakdowns in an electrostatic filter which is fed from an a-c voltage source via a rectifier, a high voltage transformer and a final control element, and wherein the overstepping of a given difference voltage value of single measured values of equal phase position of successive half-waves of the filter voltage is used as breakdown criterion.

A method of this general type is known, for example, from U.S. Pat. No. 4,138,232.

It is customary to detect a breakdown through the increase of the primary current. The sole detection of the current peaks beyond the nominal current is, however, not sufficient, since, during operation, disruptive discharges whose peaks do not exceed the nominal current frequently occur. These low current disruptive discharges, too, must be detected by the control. The current detection must therefore be designed so that current peaks after overstepping of the operating current just then prevailing by a certain percent are recognized and that thereafter control processes are triggered.

In addition to this indirect detection of disruptive discharges provided on the primary side of the voltage installation, there is direct detection to be used on the high voltage side. In the latter, one utilizes, e.g., the voltage collapse at the moment of breakdown. It makes no difference whether or not the disruptive discharge current has exceeded the nominal current limit. Since the voltage collapse also occurs at low current disruptive discharges, it is detected within the present half-wave. By indirect detection through the primary current, on the other hand, detection takes place as a rule only through the charging current peak of the half-wave following the discharge. At the moment of disruptive discharge, in fact, the primary current shows only a slight reaction. Hence, direct detection of the breakdown on the high voltage side is to be regarded as the most favorable.

A method for high voltage side detection of disruptive discharges may consist, for example, in continuously comparing the voltage amplitudes of successive half-waves of the voltage fluctuations at the separator, and using a given deviation of correlated measured values as the criterion for a breakdown.

Since experience has shown that flashovers occur after the voltage maximum of the half wave, it may, according to the solution of the above-named U.S. Pat. No. 4,138,232, suffice in many cases to compare the voltage waveforms after the amplitude maximum. To this end, for example, at fixed moments, individual voltage values in the descending flank of the separator voltage may be picked up and stored, these voltage values being compared with the measured voltage values of a following half wave at the corresponding moments, displaced by the duration of the period. If the comparison shows a considerable deviation, this may serve as criterion for the flashover.

Such an observation of breakdowns has proved successful; however, the setting of a sufficient difference over the entire filter voltage range is somewhat of a problem, for one thing because at low voltages this value would have to be made smaller than at relatively high voltages.

SUMMARY OF THE INVENTION

It is the object of the present invention to provide for immediate recognition of a breakdown over the entire possible filter voltage range.

According to the present invention, this problem is solved in that the permissible difference voltage value is preset as a percent of the respective measured filter voltage. In this way a comparison standard adapted to the respective operating conditions is available at any moment, and thus one can decide at once whether or not a breakdown exists.

For greater reliability of breakdown detection, it is advantageous to also store the crest values of the half waves in each period of the primary current and to compare them with the correlated crest values in the following network period. Then again the overstepping of a crest current different proportional to the crest current value is used as breakdown criterion.

If only the current citerion occurs, this may be regarded as an indication of a fault in the installation, since normally the voltage dependent signal should also be present.

In order to further increase the reliability of detecting the essential quantity "breakdown," it is additionally advantageous to also use a brekdown criterion the falling short of a given minimum voltage in the filter. Here again, the sole occurrence of this criterion, without the above-mentioned voltage comparison criterion, can serve as an indication of a fault in the installation.

The computations required for breakdown detection and the storing of the measured values are advantageously effected digitally, namely with the aid of a microcomputer system.

BRIEF DESCRIPTION OF THE DRAWING

FIG. 1 shows the circuit diagram of an electrostatic filter installation with breakdown detection.

FIG. 1A shows a block diagram of a microcomputer system which may be used with the present invention.

FIG. 2 is the wave form of the filter d-c voltage as a function of time.

FIG. 3 is the wave form of the primary current as a function of time.

DETAILED DESCRIPTION

An electrostatic filter 1 is fed from an alternating current network 5 via a high voltage rectifier 2 and a high voltage transformer 3. For voltage or current control there is provided in the primary circuit, e.g., a thyristor control element 4 which is energized by a digital regulator 6. This digital regulator forms, from current and voltage dependent values in connection with the breakdowns, the necessary control signals for the thyristor control element 4.

As has been mentioned above, three criteria are used for breakdown detection. These include first the voltage comparison of successive half waves of the filter voltage, second the comparison of crest values of the primary current, and third, a minimum voltage check.

The half waves of the filter voltage $U_F$ (cf. FIG. 2) are sampled—scan i=0, 1, 2 . . . —for example, twenty times, the half wave beginning with, e.g., the voltage $U_{FO}$ (N), being signaled by the external signal zero crossing of the line voltage with the period T. Twenty of these single measured values $U_{Fi}$(N) of the half wave N distributed over the half period T/2 are stored in the memory 74. Then twenty single measured values $U_{Fi}(N+1)$ of the next following half wave N+1 are sampled and stored in the memory 75, and this with the same phase position as that of the preceding half wave N. The individual measured values of equal phase of successive half waves are compared, and the voltage differences:

$$\Delta U_{Fi} = U_{Fi}(N) - U_{Fi}(N+1)$$

are formed. Each of the single voltage differences thus formed is compared in the comparator 76 with a limit value $\Delta U_{Gr}$, which is calculated from the filter voltage as follows:

$$\Delta U_{Gr} = X\ U_{Fi}(N)$$

where X may be between 0.05 and 0.2.

For the duration of the remaining half wave, the breakdown detection is suspended.

In the schematic circuit diagram, the storing and the comparison of measured values carried out simultaneously is indicated by switches 77, which are actuated by a synchronization control not shown.

To monitor the current criterion (cf. FIG. 3), the primary current $I_p$ is rectified with a rectifier 8, and the respective crest values $I_p(N)$ and $I_p(N+1)$ of a half wave and of the following half wave are stored and compared with the corresponding values $I_p(N+2)$, $I_p(N+3)$ of the following network period. Thus, there results at the comparator stage 73 connected to the memories 71 and 72 the observation of the following current differences.

$$\Delta I_p(N) = I_p(N) - I_p(N+2)$$

$$\Delta I_p(N+1) = I_p(N+1) - I_p(N+3)$$

Each of the two crest value differences is compared with a limit value which can be calculated according to the following equation:

$$\Delta I_{gr}(N) = X_i\ I_p(N)$$

$$\Delta I_{gr}(N+1) = X_i\ I_p(N+1)$$

$X_i$ being the permissible deviation of the primary current crest value. Processing of the disruptive discharge is triggered when:

$$\Delta I_p(N) > I_{gr}(N) \text{ or}$$

$$\Delta I_p(N+1) > I_{gr}(N+1).$$

During the first half wave after a breakdown and during an increasing voltage phase after a breakdown with several subsequent breakdowns, this type of breakdown detection is suspended. The signal of comparator 73 also goes, through gate 79, to the digital regulator 6. The storing and sampling and the comparison of the individual current data is also indicated by the switch 77 which is actuated by a control unit not shown.

If the filter voltage $U_F$ falls below a threshold which is picked up for instance by threshold element 78, breakdown processing is also triggered, if the detection according to the above-named two criteria did not take place, e.g., because of a fault in a converter module.

The sole release according to criterion 3—falling below the minimum voltage—just as the sole occurrence of criterion 2—elevated primary current—constitutes an anomalous operating result and cause a fault signal to be generated via gate 10.

The above-described construction with functional modules was chosen only in the interest of simpler representative. In today's technology the storage and computing functions will preferably be carried out by the microcomputer system 9 shown in FIG. 1A and replacing element 9 of FIG. 1.

This microcomputer system consists essentially of a central processing unit 91, which is the actual arithmetic and control unit, the memory 92, and the input/output devices 93, all connected to a common bus 94. The input/outlet devices 93 will, of course, include analog to digital converters for converting the sampled current and voltage, appropriate drivers for thyristors 4 etc. The micro-computer may be based on any of the currently available microprocessors such as the Motorola 6805, Intel 8080A, Z-log Z-80 etc.

What is claimed is:

1. In a method for detecting breakdowns in an electrostatic filter which is fed from an a-c voltage source via a rectifier, a high-voltage transformer and a final control element, and wherein the overstepping of a given difference voltage value of single measured values of equal phase position of successive half waves of the filter d-c voltage is used as breadown criterion, the improvement comprising presetting the difference voltage value as a percent of the respective measured filter voltage.

2. The method according to claim 1, comprising also storing the crest values of the half waves in each period of the primary current and comparing said vlaues with the correlated crest values of the following network period, and also using the overstepping of a crest current difference proportional to the crest current value as a breakdown criterion.

3. The method according to claim 2, and further evaluating the sole appearance of the current criterion as a fault signal.

4. The method according to claim 1, comprising also evaluating the falling below a minimum voltage at the filter as a breakdown criterion and using the sole appearance of this minimum voltage criterion as a fault signal.

* * * * *